United States Patent [19]

Manabe et al.

[11] Patent Number: 4,943,828

[45] Date of Patent: Jul. 24, 1990

[54] REPLACEMENT OF A CARTRIDGE USABLE WITH IMAGE FORMING EQUIPMENT

[75] Inventors: Yoshiharu Manabe, Kawasaki; Koji Sakamoto, Tokyo, both of Japan

[73] Assignee: Ricoh Company, Ltd., Tokyo, Japan

[21] Appl. No.: 359,644

[22] Filed: May 31, 1989

[30] Foreign Application Priority Data

May 31, 1988 [JP] Japan ..... 63-70990[U]
May 31, 1988 [JP] Japan ..... 63-70991[U]

[51] Int. Cl.[5] ..... G03G 15/00
[52] U.S. Cl. ..... 355/200; 355/210
[58] Field of Search ..... 355/200, 210, 211, 245, 355/133

[56] References Cited

FOREIGN PATENT DOCUMENTS 59-61847 4/1984 Japan ..... 355/210
60-131569 7/1985 Japan ..... 355/200
60-181756 9/1985 Japan ..... 355/200
60-110168 5/1986 Japan ..... 355/210

*Primary Examiner*—R. L. Moses
*Attorney, Agent, or Firm*—Oblon, Spivak, McClelland, Maier & Neustadt

[57] ABSTRACT

An apparatus applicable to an image forming apparatus allows an image carrier and a cartridge accommodating image forming process units therein to be readily positioned relative to each other and allows the cartridge to be replaced with ease. The equipment has a cover on which a positioning member is provided. When the cover is closed, the positioning member positions the image carrier and cartridge which are received in the equipment relative to each other to in turn set up a predetermined relative position of the image carrier and process units. In the event of replacement of the cartridge and image carrier, a guide member is used to guide the cartridge relative to the equipment.

7 Claims, 10 Drawing Sheets

REPLACEMENT OF A CARTRIDGE USABLE WITH IMAGE FORMING EQUIPMENT

BACKGROUND OF THE INVENTION

The present invention relates to an apparatus applicable to image forming equipment for promoting easy positioning of an image carrier and a cartridge accommodating image forming process units which are to be disposed around the image carrier, as well as easy replacement of the cartridge.

An electrophotographic copier, facsimile machine or similar image forming equipment implemented by an electrophotographic procedure has an image carrier in the form of a photoconductive element, for example. A latent image electrostatically formed on the surface of the photoconductive element is developed by a developing unit, and the resulting visible image is transferred from the photoconductive element to a paper sheet. After such image transfer, the surface of the photoconductive element is cleaned by a cleaning unit. A current trend in the image forming art is toward a disposable cartridge in which various image forming process units including the developing unit are assembled integrally with and around the photoconductive element. At the present stage of technologies, although the service life of a photoconductive element is increasing, it is still shorter than the life of the body of image forming equipment with which the element is used. Therefore, it has been customary to install a photoconductive element in a cartridge together with image forming process units so that the cartridge may be bodily replaced to allow the equipment body to be continuously used.

A problem with image forming equipment of the type using a cartridge as stated above is that, when a certain process unit built in the cartridge reaches the end of its life, the cartridge has to be discarded together with the photoconductive element even if the latter is still usable by virtue of the ever increasing life. This increases the cost of the disposable cartridge and eventually forces the user to bear extra expenses.

In the light of this, there has been proposed an arrangement wherein the photoconductive element only is built in the equipment body while the process units to be disposed around the photoconductive element are assembled in a cartridge. This scheme allows only the cartridge, i.e., the process units to be discarded independently of the photoconductive element, but it is undesirable when it comes to positioning of the image carrier and the cartridge relative to each other. Specifically, the cartridge has to be replaced by opening a cover of the equipment body and then removing a face plate on which the cartridge is mounted from, for example, the front end of the equipment body. Besides, the construction is complicated because the face plate or similar member for mounting a cartridge is needed.

In general, two different approaches are available for the replacement of a cartridge in whichh process units are accommodated, independently of a photoconductive element. One approach is to arrange process units in a cartridge such that they will be situated around the upper half of a photoconductive element, and to allow the cartridge to be replaced in the up-down direction. This kind of scheme, however, has a drawback that the arrangement of the process units is severely restricted. The other approach is to configure a cartridge, in which process units are assembled, such that it is mounted and dismounted in the axial direction of a photoconductive element. This scheme brings about another drawback that, when a used cartridge is pulled out of an equipment body away from a photoconductive element, a cleaning and a developing unit become entirely open in the cartridge resulting in toner particles from being dropped or scattered around to smear the neighborhood. Moreover, when a fresh cartridge is inserted into an equipment body, it is apt to scratch or otherwise damage the photoconductive element. In any case, one has to replace the cartridge with greatest care. In addition, when one inadvertently touches the photoconductive element during replacement of the cartridge, the life of the photoconductive element is often reduced by grease.

SUMMARY OF THE INVENTION

It is therefore an object of the present invention to provide a cartridge replacing apparatus for image forming equipment which facilitates relative positioning of an image carrier and a cartridge and cancellation of their relative position.

It is another object of the present invention to provide a cartridge replacing apparatus for image forming equipment which allows a person to replace a cartridge easily without touching an image carrier.

It is another object of the present invention to provide a cartridge replacing apparatus for image forming equipment which prevents toner particles from being dropped or scattered around from process units such as a developing unit and a cleaning unit.

It is another object of the present invention to provide a generally improved cartridge replacing apparatus for image forming equipment.

In accordance with the present invention, an apparatus for replacing a cartridge for use with image forming equipment which has a housing, a cover openably mounted on the housing, and an image carrier rotatably mounted on a shaft and having an end portion which is uncovered when the cover is opened includes a box-like cartridge accommodating at least one of a plurality of image forming process units which are to be positioned around and in a predetermined relative position to the image carrier. The cartridge is selectively coupled over and uncoupled from the image carrier. A positioning member is provided on the cover for, when the cover is closed, engaging with the image carrier and cartridge to position the image carrier and cartridge such that the predetermined relative position is maintained.

Also, in accordance with the present invention, an apparatus for replacing a cartridge usable with image forming equipment which has an image carrier rotatable about a shaft includes a box-like cartridge accommodating at least one of image forming process units which are to be situated around the image carrier and being selectively mounted in and dismounted from a housing of the equipment relative to the image carrier. Cartridge carrying members are movable between the inside and the outside of the housing for moving the cartridge when the cartridge is mounted on the cartridge carrying members. A guide member, when the cartridge mounted on the cartridge carrying members and the image carrier are mounted and dismounted relative to each other, guides the cartridge while being held in end-to-end contact with the image carrier along the shaft.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the apparatus in accordance with the present invention will be described in detail with reference to the accompanying drawings.

First Embodiment

Figure 1:
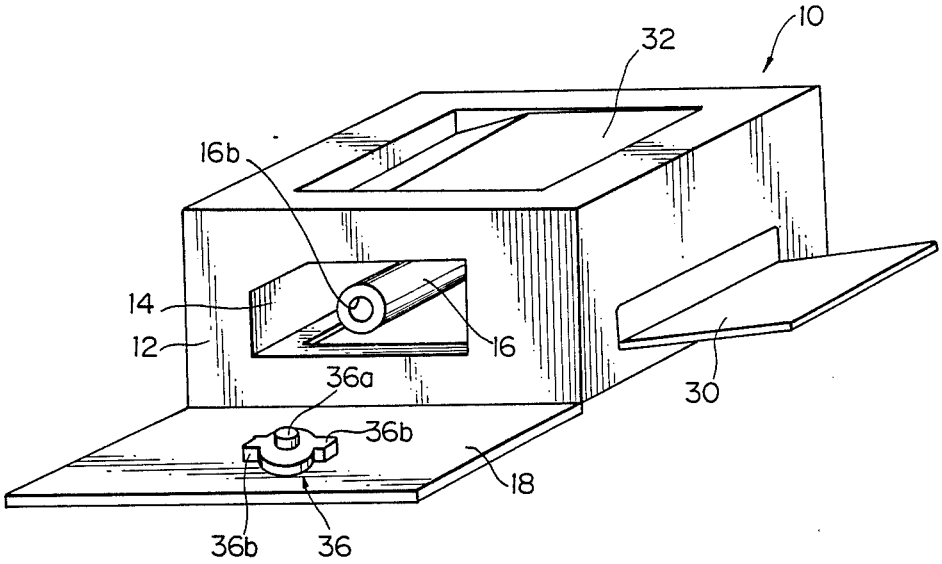
FIG. 1 is an external perspective view of image forming equipment to which a first embodiment of the cartridge replacing apparatus in accordance with the present invention is applied.
Figure 2:
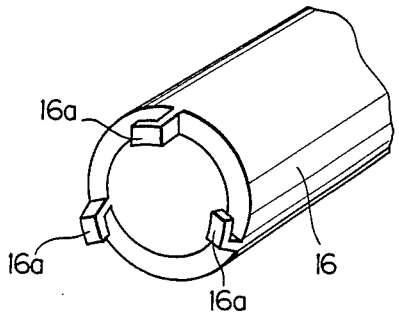
FIG. 2 is a perspective view showing one end portion of a photoconductive element included in the equipment of FIG. 1.

Referring to FIG. 1 of the drawings, an electrophotographic copier or similar image forming equipment to which an apparatus embodying the present invention is applied is shown and generally designated by the reference numeral 10. As shown, the equipment 10 has a housing 12 in which an exclusive space 14 for accommodating a box-like cartridge 20 is defined. A photoconductive element in the form of a drum 16 is disposed in a central part of the space 14. A cover 18 is openably hinged to the housing 12. While the cover 18 is open as illustrated, the drum 16 is rotatably supported in a cantilever fashion at its end remote from the cover 18, i.e. inner end. As shown in FIG. 2, three engaging lugs 16*a* are provided on that end of the drum 16 which is adjacent to the cover 18, i.e. outer end.

Figure 3:
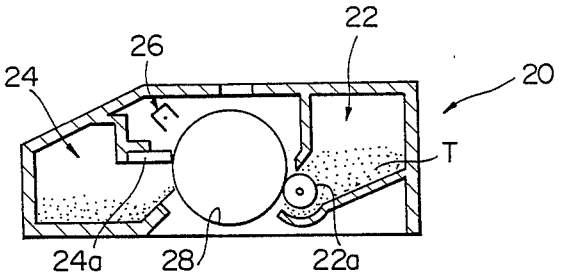
FIG. 3 is a section of a cartridge associated with the first embodiment of the present invention.

Referring to FIG. 3, the cartridge 20 is shown as accommodating a developing unit 22 having a developing sleeve 22*a*, a cleaning unit 24 having a cleaning blade 24*a*, and a charger 26. After the cover 18 has been opened as illustrated in FIG. 1, the cartridge 20 is inserted into the exclusive space 14 of the housing 12. Then, the drum 16 is located at the center of the cartridge 20, while the charger 26, developing unit 22 and cleaning unit 24 are located around the drum 16. In FIG. 3, the reference numeral 28 designates an exclusive portion occupied by the drum 16; when cartridge 20 is removed from the housing 12, the portion 28 remains simply hollow and will hereinafter be referred to as a coupling bore.

After the cartridge 20 has been mounted in the housing 12 as shown in FIG. 1, the charger 26 is energized to uniformly charge the surface of the drum 16 and, then, an electrostatic latent image is formed on the charged surface by optical writing or similar technology. The latent image is developed by a toner (FIG. 3) being supported on the developing sleeve 22*a*, and the resulting toner image is transferred to a paper sheet (not shown) which is fed from a paper tray 30. The paper sheet carrying the toner image thereon is driven out of the housing 12 onto a copy tray 32. Toner particles remaining on the drum 16 after the image transfer is scraped off by the cleaning blade 24*a* while being collected in the cleaning unit 24. It is to be noted that the cartridge 20 is further loaded with a discharger for discharging the drum 16, a charger for separating the paper sheet, etc., as needed.

Assume that the cartridge 20 is accommodated in the housing 22 of the equipment, and that the developing unit 22 of the cartridge 200 has run out of toner or the cleaning unit 24 has been filled with collected toner, i.e., its life has expired. In this condition, when the cartridge 20 is pulled out of the housing 22 to be replaced with another, the toner particles adhered to the cleaning blade 24*a* and those deposited on the developing sleeve 22*a* are apt to drop or scatter around to smear the neighborhood. Further, when a fresh cartridge is inserted into the housing 22, the edge of the cleaning blade 24*a* or similar member is likely to hit against and thereby damage the drum 16.

Figure 4:
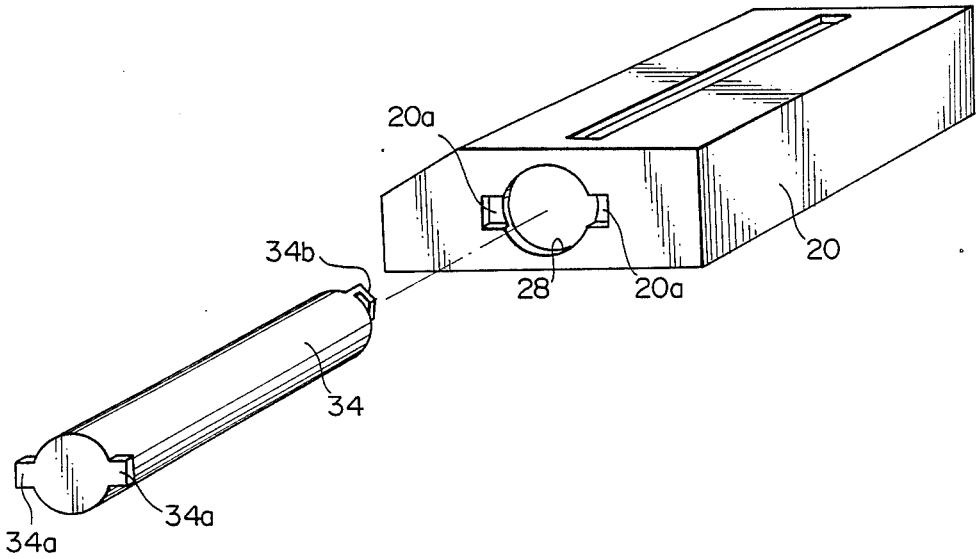
FIG. 4 is an external perspective view of the cartridge and a guide member associated therewith.

Referring to FIG. 4, there are shown the general configuration of the cartridge 20 and a guide member 34 having the same contour, i.e., the same diameter as the drum 16. Lugs 34*a* extend raidally outward from one end of the guide member 34 away from each other. Three spaced lugs 34*b* are provided on the other end of the guide member 34 so as to individually engage with the lugs 16*a* of the drum 16.

Figure 5:
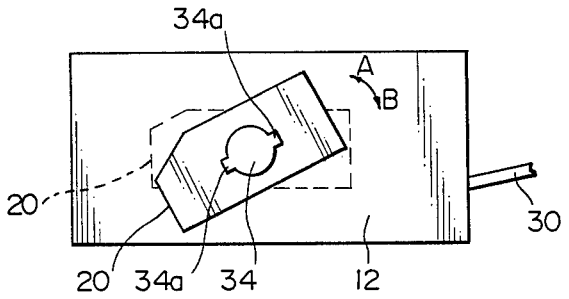
FIG. 5 is a view showing how the cartridge is mounted.
Figure 6:
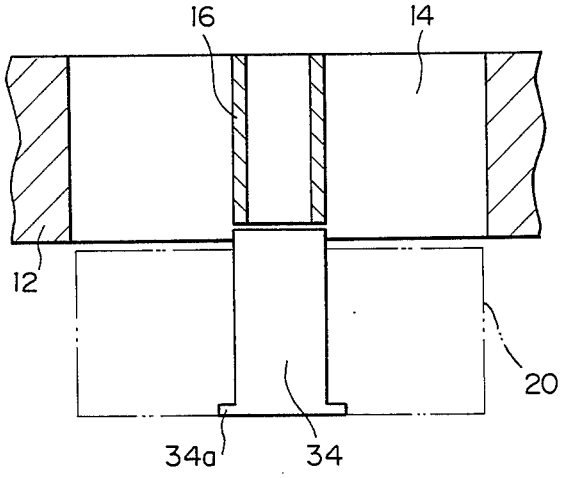
FIG. 6 is a section showing the cartridge in a position before the insertion into an equipment body.
Figure 7:
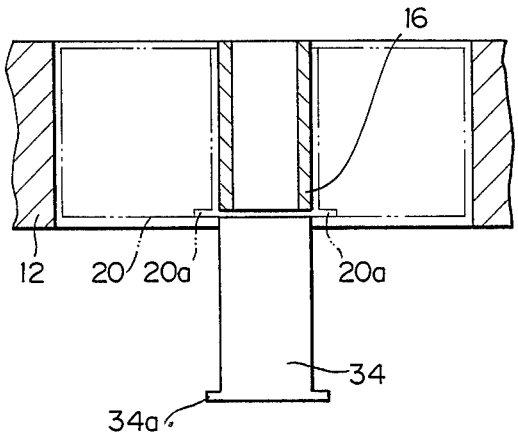
FIG. 7 is a view similar to FIG. 6, showing a condition after the insertion of the cartridge into the equipment body.

Assume that the cartridge 20 is not mounted in the housing 12, as shown in FIG. 12. To mount a new cartridge 20 in the housing 12, the guide member 34 is inserted into the coupling bore 28 of the cartridge 20 shown in FIG. 4. Two radially opposite recesses 20*a* are formed in the front end of the cartridge 20 to individually terminate at the coupling bore 28, such that the lugs 34*a* of the guide member 34 individually mate with the recesses 20*a* when the guide member 34 is fully inserted into the cartridge 20. In this condition, the guide member 34 and the cartridge 20 are not rotatable relative to each other. The cartridge 20 accommodating the guide member 34 therein is inclined in a direction A as shown in FIG. 5 to assume a position which is indicated by a solid line in the figure. In this position, the end of the cartridge 20 remote from the recesses 20*a* is brought into abutment against the front end of the equipment housing 12. Subsequently, the cartridge 20 is rotated in a direction B to a position indicated by a phantom line in FIG. 5. This position of the cartridge 20 is best shown in FIG. 6. While the cartridge 20 is rotated in the direction B toward the phantom-line position, the lugs 34*b* of the guide member 34 individually mate with the lugs 16*a* of the drum 16 resulting in the guide member 34*b* and drum 16 being coaxially joined with each other. The end of the guide member 34 where the lugs 34*b* are provided slightly protrudes from the cartridge 20 so that, when the cartridge 20 is held in the solid-line position shown in FIG. 5, the end of the guide member 34 may abut against the end of the drum 16. While the cartridge 20 is inclined as indicated by the solid line, the lugs 34*b* of the guide member 34 do not mate with the lugs 16*a* of the drum 16. The lugs 16*a* and 34*b* are not shown in FIG. 6 for the clarity of illustration. After the guide member 34 and drum 16 have been joined together, the cartridge 20 is inserted into the housing 12 while being guided by the guide member 34. FIG. 7 shows the cartridge 20 being received in the housing 12.

Figure 8:
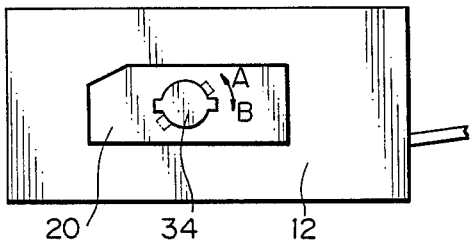
FIG. 8 is a view showing the rotation of the guide member.

The cartridge 20 is inserted into the housing with its axis being aligned with the axis of the drum 16 due to the guide member 34. This is successful in preventing the cleaning blade 24*a* or similar member associated with the cartridge 20 from hitting against the drum 16. In addition, the operator's fingers are surely isolated from the drum 16 during the insertion of the cartridge 20, otherwise they would reduce the life of the drum 16 due to grease. After the cartridge 20 has been fully inserted into the housing 20 as shown in FIG. 7, the guide member 34 is rotated from the position A to the position B as shown in FIG. 8. This releases the lugs 34*b* of the guide member 34 from the lugs 16*a* of the drum 16, whereby the guide member 34 can be readily removed from the drum 16.

To remove the used cartridge 20 from the housing 12 while leaving the drum 16 in the latter, the guide member 34 is abutted against the drum 16, as shown in FIG. 7. Then, the lugs 34*b* of the guide member are caused to mate with the lugs 16*a* of the drum 16 to thereby join the two members 34 and 16. In this condition, the cartridge 20 is pulled out of the housing 12 while being guided by the guide member 34. The cartridge 20 removed from the housing 12 is discarded with or without the guide member 34 being left thereinside. In this manner, the cartridge 20 being removed from the housing 12 has its interior sequentially covered by the guide member 34, whereby toner particles are prevented from dropping or scattering around from the developing unit 22 and cleaning unit 24. During the removal of the cartridge 20, as during the insertion of the same, the operator's fingers are surely prevented from touching the drum 16.

In the illustrative embodiment, the developing unit 22 and cleaning unit 24 are assembled together in a cartridge. Alternatively, only one of such units may be built in a cartridge. Further, even one or more of other image forming process units may be arranged in a cartridge.

While the guide member 34 has been shown and described as being joined with the drum 16 by the engagement of lugs, such lugs do not constitute any essential part of the illustrative embodiment. Specifically, a cartridge may be inserted into the housing 12 by simply abutting the end of such a guide member against the end of the drum 16 and may be pulled out from the housing 12 by holding the guide member in abutment against the drum 16 by hand.

Referring again to FIG. 1, after the cartridge 20 has been fully inserted in the equipment housing 12 to surround the drum 16, the cartridge 20 and the drum 16 have to be positioned relative to each other so that the various process units of the cartridge 20 may be positioned accurately relative to the drum 16. Should the cartridge 20 be dislocated relative to the drum 16, the relative position of the developing sleeve and cleaning blade 24*a* and the drum 16 shown in FIG. 3 would be disturbed. In the illustrative embodiment, the dislocation of the cartridge 20 relative to the drum 16 is eliminated by a positioning member 36 which is provided on that surface of the cover 18 which is adjacent to the drum 16. Specifically, as shown in FIG. 1, the positioning member 36 has a pin-like projection 36*a* at its center and a pair of radially opposite projections 36*b* at its periphery. The projections 36*b* extend out from a disk-like major portion of the positioning member 36.

In this configuration, assume that the cover 18 is closed after the cartridge 20 has been accommodated in the equipment housing 12. Then, the projection 36*a* mates with a recess or bore 16*b* which is formed in the drum 16 while the lugs 36*b* individually mate with the recesses 20*a* of the cartridge 20. As a result, the positioning member 36 positions the outer or front end of the drum 16 while positioning the cartridge 20 relative to the drum 16 in the previously stated relationship. The projection 36*a* serves as a bearing for the drum 16 also, i.e., it rotatably supports the outer end of the drum 16. Preferably, therefore, the projection 36*a* is made of a wear-resistant material. If desired, the recess or bore 16*b* of the drum 16 may be used, in place of the engaging lugs 16*a*, to coaxially join the guide member 34 and drum 16. The radially opposite projections 36*b* of the positioning member 36 have the same shape as the radially opposite lugs 34*a* of the guide member 34, so that the projections 36*b* and lugs 34*a* may be selectively received in the recesses 20*a* of the cartridge 20.

The engagement of the projection 36*a* of the positioning member 36 with the bore 16*b* of the drum 16 has been stated on the assumption that the lugs 16*a* shown in FIG. 2 are absent on the end of the drum 16 (FIG. 1). When the lugs 16*a* are provided on the drum 16, the positioning member 36 will be configured by taking account of the dimensions of the lugs 16*a*. If desired, the lugs 16*a* may be so configured as to be removable from the drum 16, in which case the projection 36*a* can mate with the bore 16*b* of the drum 16 in the same manner as in the illustrative embodiment. The positioning member 36 is located on the cover 18 such that it accurately positions the drum 16 and the cartridge 20 to each other, insuring an extremely accurate positional relationship when the cover 18 is closed (during operation).

Heretofore, it has been customary to remove the cartridge 20 from the equipment housing 12 by opening the cover 18 to the position shown in FIG. 1, then pulling out a face plate (not shown) or similar member which is mounted on the front end of the housing 12 and thereby rendering the front end of the drum 16 free, and then removing the cartridge 20 from the face plate. In the illustrative embodiment, the cartridge 20 can be pulled out simply by opening the cover 18 and, since the front end of the drum 16 is made free automatically, the cartridge 20 can be removed immediately without any obstruction. When the cover 18 is closed after the insertion of a new cartridge 20, the cartridge 20 is positioned relative to the drum 16 automatically. In addition, the absence of a face late or similar member also contributes a great deal to the simplification of the construction.

In FIG. 1, the projection 36*a* may be tapered toward its tip to further promote smooth positioning of the drum 16. The projection 36*a* may be configured slidable and constantly biased toward the drum 16 by a spring or similar biasing means. This alternative configuration will allow the inner end of the drum 16 in the housing 12 to be desirably connected to a driving section. The positioning member 36 may be molded integrally with the cover 18 by using synthetic resin in order to achieve more accurate positioning than would be available with screws or similar fastening means. In this case, the major disk-like portion of the positioning member 36 may be left hollow at the back of the projection 36*a* to allow the projection 36*a* to elastically deform in the axial direction thereof. This will also be successful in insuring the connection of the inner end of the drum 16 with a driving section.

Second embodiment

Figure 9:
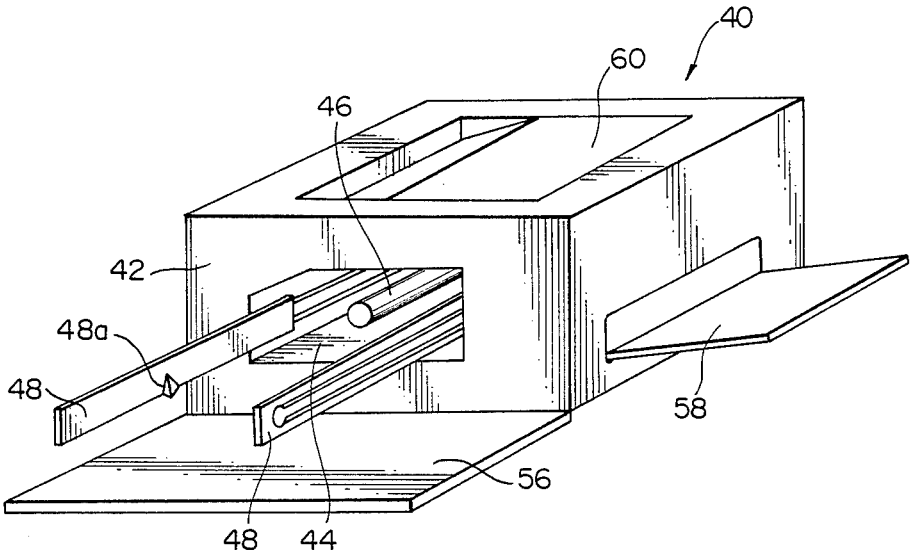
FIG. 9 is an external perspective view of image forming equipment to which a second embodiment of the present invention is applied.

Referring to FIG. 9, an electrophotographic copier or similar image forming equipment 40 is shown to which a second embodiment of the present invention is applied. As shown, the equipment 40 has a housing 42 in which an exclusive space 44 for receiving a cartridge 50, which will be described, is defined. A shaft 46 is disposed at the central part of the space 44 for supporting and guiding a photoconductive element 52, as described in detail later. The shaft 46 is cantilevered by the housing 42 at its inner end. A pair of spaced cartridge carrier members 48 are disposed in the housing 42, and each is provided with a lug 48*a*. The cartridge carrier members 48 are supported by suitable bearing means in such a manner as to be slidable into and out of the housing 42.

Figure 10:
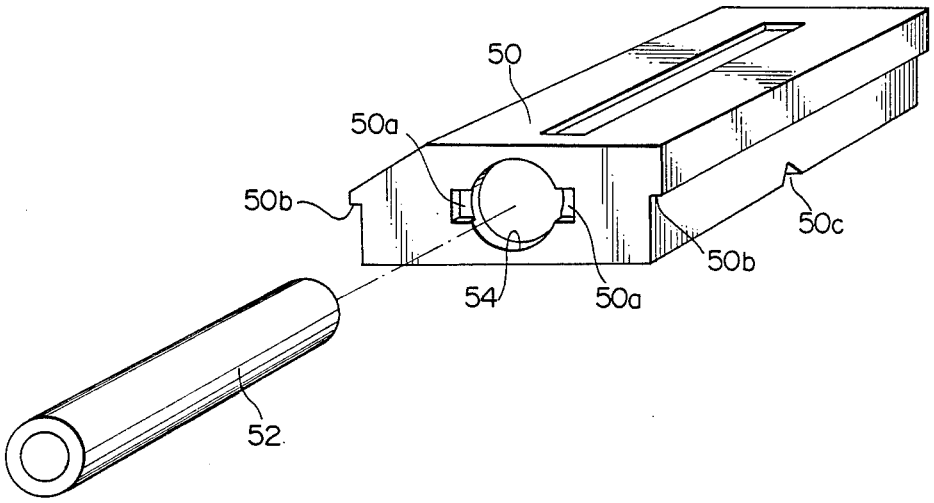
FIG. 10 is an external perspective view of a photoconductive element and a cartridge in accordance with the second embodiment.
Figure 11:
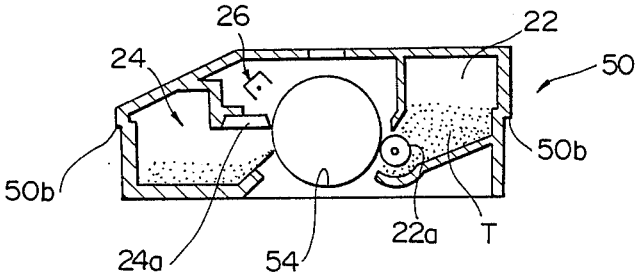
FIG. 11 is a section of the cartridge.

FIG. 10 shows a cartridge 50 and a photoconductive element in the form of a drum 52. The cartridge 50 is formed with a coupling bore 54 for receiving the drum 52 and a guide member which will be described. The cartridge 50 is also formed with radially opposite recesses 50*a* which are contiguous with the opening 54, shoulders 50*b* engageable with the cartridge carrier members 48, and notches 50*c* individually engageable with the lugs 48*a* of the cartridge carrier members 48. The cartridge 50 is positioned relative to the cartridge carrier members 48 in the axial direction when its notches 50*c* are mated with the lugs 48*a* of the cartridge carrier members 48. The cartridge 50 is constructed essentially in the same manner as the cartridge 20 of FIG. 4, except for the shoulders 50*b* and notches 50. Of course, the developing unit 22, cleaning unit 24 and charger 26 will be located around the drum 52 when the cartridge 50 is mounted in the housing 42, as shown in FIG. 11.

When the drum 52 shown in FIG. 10 is inserted into the cartridge 50 through the coupling bore 54, it occupies the central part of the cartridge 50 while the charger 26, developing unit 22 and cleaning unit 24 are disposed around the drum 52. After the cartridge 50 accommodating the drum 52 therein has been loaded on the cartridge carrier members 48 shown in FIG. 9, the members 48 are slid into the housing 42 entrailing the cartridge 50. Then, a cover 56 is closed. In operation, the charger 26 shown in FIG. 11 uniformly charges the surface of the drum 52. A latent image is electrostatically formed on the charged surface of the drum 52 by optical writing or similar technology. The latent image is developed by a toner T which is carried on the developing sleeve 22*a* of the developing unit 22, and the resulting toner image is transferred from the drum 52 to a paper sheet (not shown) which is fed from a paper tray 58 (FIG. 9). The paper sheet carrying the toner image thereon is driven out onto a copy tray 60. After the image transfer, toner particles remaining on the drum 52 are removed by the cleaning blade 24*a* and thereby collected in the cleaning unit 24. The cartridge 11 may be loaded with a discharger for discharging the drum 52, a charger for separating a paper sheet from the drum 52, etc., as needed.

Figure 12A:
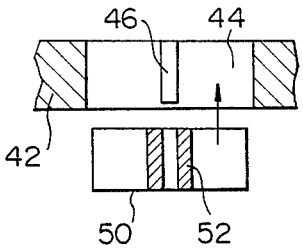
FIGS. 12A to 12G are sketches demonstrating a sequence of steps for replacing a used cartridge with a fresh cartridge.
Figure 12B:
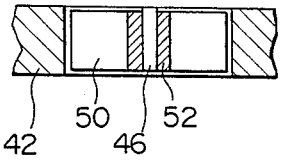

FIG. 12A indicates the cartridge 50 which has received the drum 52 therein but has not yet been inserted in the equipment housing 42. When the cartridge 50 is loaded on the cartridge carrier members 48 (FIG. 9) and then the members 48 are slid into the housing 42, the cartridge 50 enters the exclusive space 44 defined in the housing 42 so that the drum 52 is coupled over the shaft 46, as shown in FIG. 12B. The equipment 40 is operable in the condition shown in FIG. 12B, until the time for replacing the cartridge 50 is reached. When the cartridge 50 is to be replaced due to an occurrence that the developing unit 22 has run out of toner or the cleaning unit 24 has been filled with used toner, for example, the cartridge 50 is separated from the drum 52 to be discharged while the drum 52 is reused.

Figure 12C:
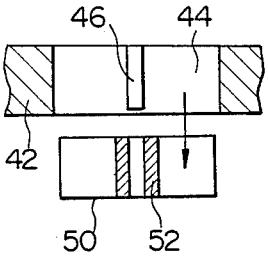
Figure 12D:
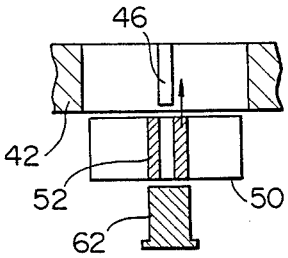
Figure 13:
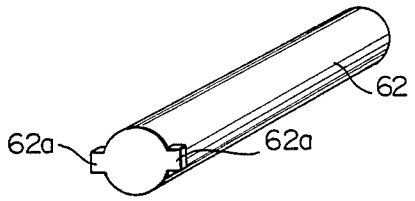
FIG. 13 is an external perspective view of a guide member.

FIGS. 12C to 12D illustrate a sequence of steps for replacing the cartridge 50 as stated above. First, as shown in FIG. 12C, the cartridge 50 is pulled out of the exclusive space 44 of the housing 42 by opening the cover 56 (FIG. 9) and then sliding the cartridge carriers 48 out of the housing 42. At this instant, the drum 52 is removed from the shaft 46. In this manner, the cartridge 50 can be pulled out merely by sliding the cartridge carrier members 48 out of the housing 42. Subsequently, a guide member 62 is used to thrust the drum 52 out of the cartridge 50 which is loaded on the cartridge carrier members 48. As shown in FIG. 13, the guide member 62 has the same contour, i.e., the same diameter as the drum 52 and is provided with radially opposite projections 62*a* at one end thereof.

Figure 12E:
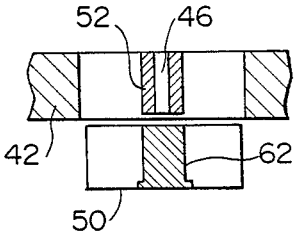

The cartridge 50 is strictly positioned on the cartridge carrier members 48 in the vertical and lateral directions. Hence, when the drum 52 is pushed by the guide member 62 in a direction indicated by an arrow in FIG. 12D, it is driven out of the cartridge 50 while coupling itself over the shaft 46 in a coaxial relation to the latter. Finally, the drum 52 is fully mounted on the shaft 46, as shown in FIG. 12E. When the guide member 62 fully forces the drum 52 out of the cartridge 50, it in turn is fully received in the coupling bore 54 of the cartridge 50 with its projections 62*a* mating with the recesses 50*a* (FIG. 10) of the cartridge 50. In the transitional state shown in FIG. 12D, the guide member 62 sequentially enters the coupling bore 54 while sequentially forcing the drum 52 out of the bore 54. This prevents the interior 50 of the cartridge 50 from being uncovered and thereby eliminates the fear that the toner particles drop or scatter around from the developing unit 22 (FIG. 11) and cleaning unit 24 which are assembled in the cartridge 50. The drum 52 is completely isolated from the operator's fingers which would otherwise reduce the life of the drum 52 due to grease. The cartridge 50 shown in FIG. 12E is not usable any longer and, therefore, discarded with or without the guide member 62 being left therein.

Figure 12F:
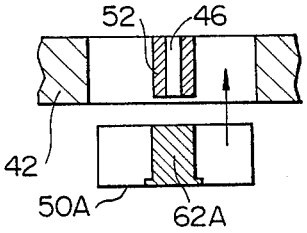
Figure 12G:
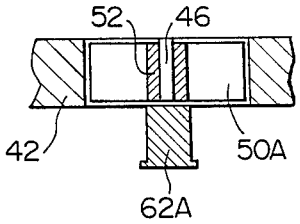

As shown in FIG. 12F, a fresh cartridge 50A in which a guide member 62A is received is prepared and loaded on the cartridge carriers 48. Then, the cartridge carrier members 48 are slid into the equipment housing 42 so that the leading end of the guide member 62A is brought into abutment against the outer end of the drum 52. As the cartridge carriers 48 are moved deeper into the housing 42, the cartridge 50A is brought into the housing 42 together with the cartridge carrier members 48 while the guide member 62A is thrusted outward by the drum 52. Finally, the guide member 62A is bodily driven out of the new cartridge 50A, as shown in FIG. 12G. The cartridge 50A is accommodated in the housing 42 while coupling over the drum 52. The guide member 62A driven out of the cartridge 50A may discarded or stored for future replacement of the cartridge 50A.

By the procedure described above, the used cartridge 50 is replaced with the new cartridge 50A on condition that the drum 52 be reused.

When the new cartridge 50A is mounted on the cartridge carrier members 48, its notches **50*c* (FIG. 10) individually mate with the lugs 48*a* (FIG. 9) of the members 48. In this condition, the cartridge 50A is inhibited from moving relative to the cartridge carrier members 48. An arrangement is made such that when the cartridge 50A is loaded on the cartridge carrier members 48, the axis of the guide member 62A and that of the drum shaft 46 align with each other. Hence, as the cartridge carrier members 48 loaded with the cartridge 50A is slid into the housing 42, the cartridge 50A is automatically and surely coupled over the drum 52 while the guide member 62A is thrusted out of the cartridge 50A. That is, the cartridge 50A can be mounted in the housing 42 simply by sliding the cartridge carrier members 48 into the housing 42**.

While the replacement is under way, the interior of the cartridge 50A is constantly closed by the guide member 62A and drum 52 so that toner filled in the developing unit 22, for example, is prevented from scattering around out of the cartridge 50A. Further, since the cartridge 50A is inserted into the housing 42 in alignment with the drum 52, the cleaning blade **34*a* or the like built in the cartridge 50A is prevented from scratching or otherwise effecting the drum 52. In any case, the guide member 62, 62A serves to guide the cartridge 50, 50A in abutment against the end of the drum 52 while the cartridge 50, 50A is coupled and uncoupled from the drum 52**.

When the time for replacing the drum 52 is reached after a plurality of times of cartridge replacement, the cartridge 50 shown in FIG. 12B is brought out of the housing 42 by the cartridge carriers 48 together with the drum 52 and then bodily discarded.

Again, only one of the developing unit 22 and cleaning unit 24 may be assembled in a cartridge, or one or more of other image forming process units may built in a cartridge.

In the illustrative embodiment, a drum is movable into and out of an equipment housing so that a cartridge may be replaced alone or together with the drum, depending upon the life of the drum. The cartridge is once pulled out of the equipment housing together with the drum, and then the drum which does not need replacement is returned into the housing. A third embodiment which will be described is so constructed as to replace a cartridge while leaving a drum in an equipment housing.

Third Embodiment

Figure 14:
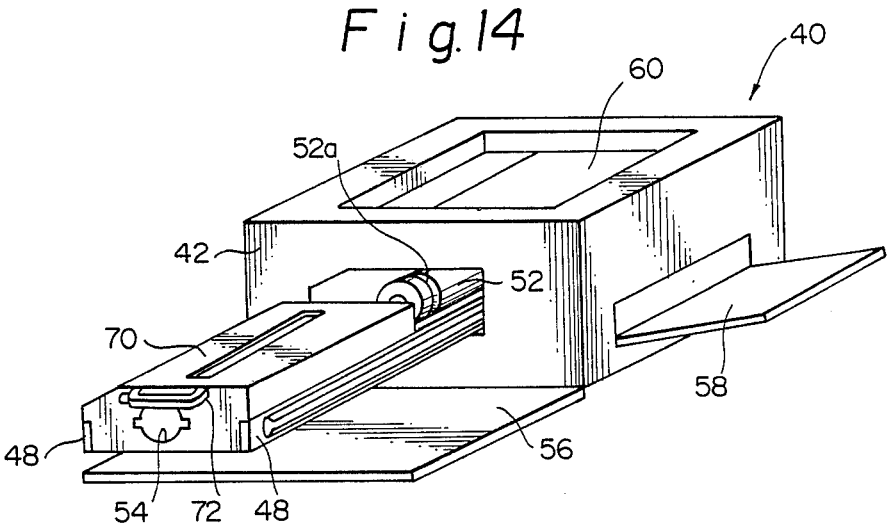
FIG. 14 is an external perspective view of image forming equipment to which a third embodiment of the present invention is applied.
Figure 15:
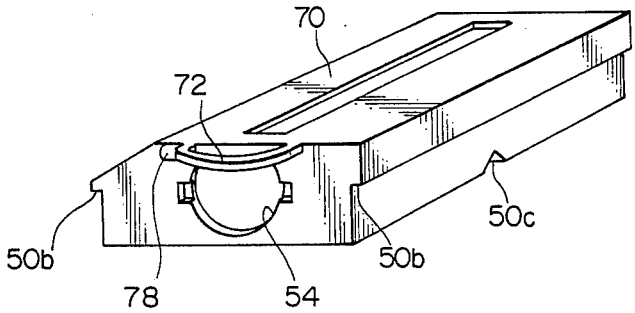
FIG. 15 is an external perspective view of a cartridge in accordance with the third embodiment.
Figure 16A:
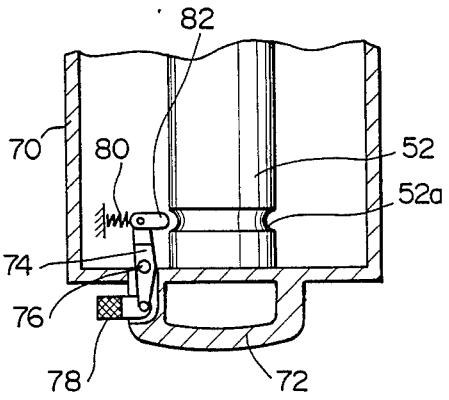
FIGS. 16A and 16B are fragmentary sections representative of the operation of a locking lever for locking and unlocking a photoconductive element.

FIG. 14 shows image forming equipment 40 to which a third embodiment of the present invention is applied. In the figures, similar components or structural elements are designated by the same reference numerals, and redundant description will be avoided for simplicity. As shown in FIG. 14, a drum 52 is disposed in the equipment housing 42 and provided with a circumferential groove **52*a*. As shown in FIGS. 14 and 15, a cartridge 70 has a knob 72 at the front end thereof. Further, as shown in FIG. 16A, a locking lever 74 is rotatable about a pin 76 which is studded on the cartridge 70. The locking lever 74 is so positioned as to protrude to the outside of the cartridge 70. The locking lever 70 has a thumb piece 78 at one end thereof. When the thumb piece 78 is not pressed, a stop 82 fitted on the other end of the locking lever 74 is received in the circumferential groove 52*a* of the drum 52 by the action of a compression spring 80**.

Figure 17A:
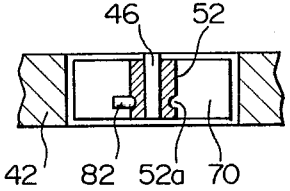
FIGS. 17A to 17E are sketches showing a sequence of steps for replacing a used cartridge with a fresh cartridge in accordance with the third embodiment.
Figure 17B:
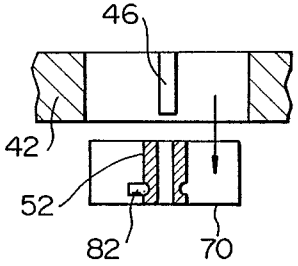
Figure 17C:
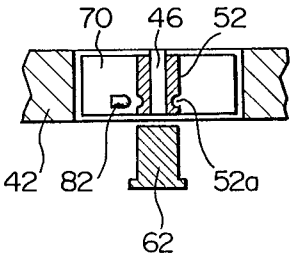

Assume that the cartridge 70 shown in FIG. 14 is accommodated in the equipment housing 42, and that the drum 52 disposed in the housing 42 is received in the coupling bore 54 of the cartridge 70, as shown in FIG. 17A. In this condition, the stop 82 of the locking lever 70 is held in engagement with the groove **52*a* of the drum 52. To replace the cartridge 70 together with the drum 52, the cartridge carrier members 48 loaded with the cartridge 70 is pulled out of the housing 42 with the knob 72 being held by hand, but without the thumb piece 74 being pressed. Then, the cartridge 70 is brought out out of the housing 42 together with the drum 52 because the drum 52 and cartridge 70 are joined together by the stop 82. For example, the drum 52 is joined with the drum shaft 46 by being relatively tightly coupled over the shaft 46. While the stop 82 is received in the groove 52*a* to maintain the drum 52 and cartridge 70 unitary with each other, the drum 52 may be forcibly pulled away from the drum 46. FIG. 17B shows a condition in which the cartridge 70 is drawn out of the housing 42 together with the drum 52. In this condition, the cartridge 70 may be discarded together with the drum 52** after cartridge replacement has been repeated a plurality of times.

Figure 16B:
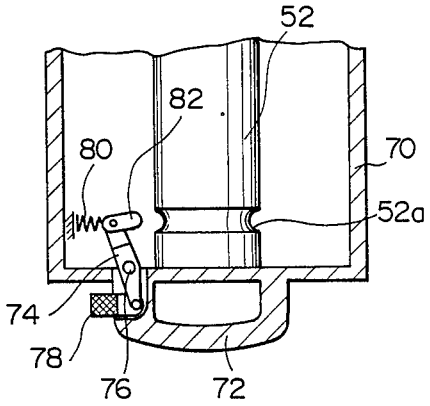
Figure 17D:
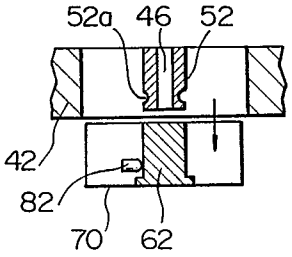

On the other hand, to replace the cartridge 70 while leaving the drum 52 in the equipment housing 42, the guide member 62 shown in FIG. 62 is used. When the leading end of the guide member 62 is abutted against the outer end of the drum 52 and the thumb piece 78 of the locking lever 74 shown in FIG. 16A is pressed, the locking lever 74 is rotated to the position shown in FIG. 16B. As a result, the stop 82 is released from the groove **62*a* to in turn release the drum 52 from the cartridge 70. As one pulls out the cartridge carriers 48 which is loaded with the cartridge 70 from the equipment housing 42 by holding the knob 72, the cartridge 70 is drawn out of the housing 42 with the drum 52 being left on the shaft 46. More specifically, since the drum 52 and shaft 46 are tightly coupled with each other, only the cartridge 70 is removed from the housing 42, as shown in FIG. 17D. At this instant, the guide member 62 mates with the cartridge 70 to physically isolate the interior of the latter from the outside. The cartridge 70** may be discarded in such a condition.

Figure 17E:
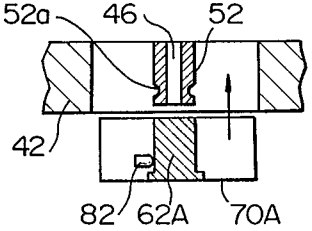

Subsequently, as shown in FIG. 17E, a new cartridge 70A with a guide member 62A is mounted on the cartridge carriers 48, and then the cartridge carrier members 48 are slid into the equipment housing 42. As a result, the drum 52 left in the housing 42 enters the coupling bore 54 of the cartridge 70A while forcing the guide member 62A received in the cartridge 70A out of the cartridge 70A. The stop 82 of the locking lever 74 slides on the periphery of the guide member 62A until it mates with the groove 52*a* of the drum 52, whereby the cartridge 70A is locked in position. By this procedure, the fresh cartridge 70A is securely received in the housing 42.

Likewise, a new cartridge 70A accommodating a fresh drum 52A thereinside is loaded on the cartridge carrier members 48. As the cartridge carrier members 48 are slid into the equipment housing 42 entraining the cartridge 70A, the drum 52A is automatically coupled over the shaft 46 (FIG. 17B) while the cartridge 70A is positioned in the housing 42.

Again, the interior of the cartridge 70 is closed by the guide member 48 when it is pulled out of the housing 42. This is successful in preventing toner particles from scattering around out of the developing unit 22 and cleaning unit 24. One can replace the cartridge without touching the drum 52, so that the drum 52 is free from the decrease in service life due to grease.

It will be seen that the guide member 62 plays the role of a slide guide in the event when the cartridge 70 is mounted and dismounted, in cooperation with the drum 52. Besides, since the guide member 62 is received in the cartridge 70 while the latter is stored for future use, it protects the interior of the cartridge against dust and other impurities and, in this sense, serves as a dummy drum.

Only one of the developing unit 22 and cleaning unit 24 may be arranged in a cartridge, or one or more of other process units may be assembled in a cartridge, as stated earlier in relation to the preceding embodiments.

In summary, in accordance with the present invention, one can selectively position an image carrier and a cartridge relative to each other and cancel the relative position simply by opening a cover of image forming equipment, and can replace the cartridge without touching the image carrier. Toner particles are prevented from dropping from a developing unit, cleaning unit and other process units, so that the neighborhood is free from contamination. Easy replacement of the cartridge is further enhanced by the fact that the cartridge is replaced in interlocked relation to the sliding motion of cartridge carrier members. In addition, since the cartridge can be replaced with the image carrier being loaded thereon, one can discharge a used cartridge with or without an image carrier being left thereon.

Various modifications will become possible for those skilled in the art after receiving the teachings of the present disclosure without departing from the scope thereof.

What is claimed is:

1. An apparatus for replacing a cartridge for use with image forming equipment which has a housing, a cover openably mounted on said housing, and an image carrier rotatably mounted on a shaft and having an end portion which is uncovered when said cover is opened, said apparatus comprising:

a box-like cartridge accommodating at least one of a plurality of image forming process units which are to be positioned around and in a predetermined relative position to the image carrier, said cartridge being selectively coupled over and uncoupled from the image carrier; and positioning member provided on the cover for, when the cover is closed, engaging with the image carrier and said cartridge to position said image carrier and said cartridge such that the predetermined relative position is maintained.

2. An apparatus as claimed in claim 1, wherein said cartridge comprises a coupling bore through which the image carrier is inserted into and removed from interior of said cartridge along the shaft, and recesses contiguous with said coupling bore.

3. An apparatus as claimed in claim 2, wherein the image carrier comprises a bore formed in the end portion thereof, said positioning member comprising a first projection engageable with said bore of the image carrier and second projections individually engageable with said recesses of said cartridge.

4. An apparatus for replacing a cartridge usable with image forming equipment which has an image carrier rotatable about a shaft, comprising:

a box-like cartridge accommodating at least one of image forming process units which are to be situated around the image carrier and being selectively mounted in and dismounted from a housing of the equipment relative to said image carrier;

cartridge carrying means movable between inside and outside of the housing for moving said cartridge when said cartridge is mounted on said cartridge carrying means; and guide means for, when said cartridge mounted on said cartridge carrying means and the image carrier are mounted and dismounted relative to each other, guiding said cartridge while being held in end-to-end contact with said image carrier along the shaft.

5. An apparatus as claimed in claim 4, wherein said guide means comprises a member having an axis which aligns with an axis of the image carrier and having the same contour and dimensions as said image carrier.

6. An apparatus as claimed in claim 4, further comprising locking means for locking in position the image carrier which is received in said cartridge.

7. An apparatus as claimed in claim 6, wherein said image carrier comprises a groove formed in an end portion of said image carrier, said locking means comprises a locking lever engageable with said groove.

* * * * *